US007741571B2

(12) United States Patent
Hostmann et al.

(10) Patent No.: US 7,741,571 B2
(45) Date of Patent: Jun. 22, 2010

(54) ROTARY/PUSH-BUTTON CONTROLLER

(75) Inventors: Daniel Hostmann, Regensburg (DE); Nhu Nguyen Thien, Regensburg (DE)

(73) Assignee: Siemens VDO Automotive AG, Regensburg (DE)

( * ) Notice: Subject to any disclaimer, the term of this patent is extended or adjusted under 35 U.S.C. 154(b) by 354 days.

(21) Appl. No.: 11/922,383

(22) PCT Filed: Mar. 5, 2007

(86) PCT No.: PCT/EP2007/052048

§ 371 (c)(1),
(2), (4) Date: Dec. 14, 2007

(87) PCT Pub. No.: WO2007/115869

PCT Pub. Date: Oct. 18, 2007

(65) Prior Publication Data

US 2009/0127078 A1 May 21, 2009

(30) Foreign Application Priority Data

Apr. 4, 2006 (DE) ..... 10 2006 015 684

(51) Int. Cl.
*H01H 25/06* (2006.01)

(52) U.S. Cl. ..... 200/18; 200/336

(58) Field of Classification Search ..... 200/336, 200/18, 566, 4, 179; 74/10.27
See application file for complete search history.

(56) References Cited

U.S. PATENT DOCUMENTS 6,348,772 B1 2/2002 May
7,238,904 B2 * 7/2007 Ogawa ..... 200/336
7,342,186 B2 * 3/2008 Montalvo et al. ..... 200/336

(Continued)

FOREIGN PATENT DOCUMENTS

DE 199 41 952 A1 3/2001

(Continued)

OTHER PUBLICATIONS

International Search Report dated Jun. 15, 2007 issued in corresponding application PCT/EP2007/052048.

(Continued)

*Primary Examiner*—Felix O Figueroa
(74) *Attorney, Agent, or Firm*—Cohen Pontani Lieberman & Pavane LLP

(57) ABSTRACT

The invention relates to a rotary/push-button controller having a controller ring (18) which can be rotated about a rotation axis (7) and is arranged such that it can rotate on a holding cylinder (6) which is arranged coaxially within the control ring (18). In this case, the holding cylinder (6) is provided at its end with an input and/or display field (14), and the control ring (18) and the holding cylinder (6) can be moved axially with respect to the rotation axis (7) against a spring force from a neutral position to a switch position which operates a switching element. The input and/or display field (14) is mounted so that it can rotate about the rotation axis (7). A rotary transmitter ring is arranged coaxially on the control ring (18) and is arranged coaxially alongside a rotary transmitter (17) which is firmly connected to the holding cylinder (6) with the relative rotation position of the rotary transmitter ring with the respect to the rotary transmitter (17) being recordable.

31 Claims, 2 Drawing Sheets

U.S. PATENT DOCUMENTS

| | | | | |
|---|---|---|---|---|
| 7,361,854 | B2 * | 4/2008 | Basche et al. | 200/18 |
| 7,450,108 | B2 * | 11/2008 | Clabunde et al. | 200/18 |
| 2003/0044000 | A1 | 3/2003 | Kfoury et al. | |
| 2004/0118664 | A1 | 6/2004 | DePue et al. | |
| 2004/0207607 | A1 | 10/2004 | Specks et al. | |

FOREIGN PATENT DOCUMENTS

| | | | |
|---|---|---|---|
| DE | 10 2004 010 310 | A1 | 12/2004 |
| EP | 1 010 585 | A1 | 6/2000 |
| EP | 1 434 244 | A1 | 6/2004 |
| JP | 2004-185927 | | 7/2004 |
| WO | WO 03/021919 | A1 | 3/2003 |

OTHER PUBLICATIONS

German Office Action dated Jan. 29, 20076 issued in corresponding application 10 2006 015 684.6-34.

* cited by examiner

ROTARY/PUSH-BUTTON CONTROLLER

CROSS REFERENCE TO THE RELATED APPLICATIONS

This is a U.S. national stage of application No. PCT/EP2007/052048, filed on 5 Mar. 2007. Priority is claimed on German Application No. DE 10 2005 026 206.6, filed 7 Jun. 2005, the content of which is incorporated herein by reference.

BACKGROUND OF THE INVENTION

The invention relates to a rotary/pushbutton controller having an operator control ring which can be rotated about a rotational axis and which is rotatably mounted on a holding cylinder which is arranged coaxially within the operator control ring, wherein the holding cylinder is provided at one of its ends with an input and/or display field and the operator control ring and/or the holding cylinder can be moved axially with respect to the rotational axis counter to a spring force from a neutral position into a switched position which activates a switch, having a rotary transmitter ring which is arranged coaxially on the operator control ring and is arranged coaxially next to a rotary transmitter which is fixedly connected to the holding cylinder, wherein the relative rotational position of the rotary transmitter ring with respect to the rotary transmitter can be sensed.

In such a rotary/pushbutton controller, it is known that only the operator control ring but not the holding cylinder and the rotational axis can be rotated.

Such a rotary/pushbutton controller is used in particular in a motor vehicle for control of, for example, a multimedia system or navigation system or a vehicle subsystem such as an air-conditioning system. In this context, for example, the selection of a menu item can be made by rotating the operator control ring, the menu item is then selected by pressing the operator control ring, where the holding cylinder and/or the input and display field and switching the switching element.

Numbers, letters or symbols can be displayed and/or selected on the input and display field independently of the operator control ring.

It is also possible to make the input and display field sensitive and to use it for menu prompting and/or data input.

For example, it is possible to input lines, symbols, numerals or letters by moving a finger on the input and display field.

Since the input and display field in the motor vehicle is fixed, the position is optimized for the driver as a right-handed person in a left-hand drive vehicle. If the driver is left-handed or if the front seat passenger also attempts to activate the rotary/pushbutton controller, this activation is possible only with difficulty.

SUMMARY OF THE INVENTION

It is therefore an object of the invention to provide a rotary/pushbutton controller which can be operated satisfactorily when arranged differently with respect to a position of the operator and from various operator positions.

These and other objects and advantages are achieved in accordance with the invention by mounting the input and/or display field so as to be rotatable about the rotational axis.

It is thus possible to rotate the input and/or display field into an operator position which is adapted to the respective operator and in which both satisfactory inputting and satisfactory legibility are possible.

A front seat passenger who writes with his right hand is thus no longer required to stretch his arm and extend his shoulder excessively, as well as twist his wrist, in order to be able to correctly reach the writing surface.

This also applies to a left-handed driver.

The rotary/pushbutton controller is suitable both for left-hand drive vehicles and for right-hand drive vehicles without reconstruction.

In order to permit both the driver and the front seat passenger to easily reach and operate the rotary/pushbutton controller, the rotary/pushbutton controller is arranged, for example, on the central armrest or in the region of the central console.

on the central armrest or in the region of the central console.

Well-guided mounting is achieved by fixedly arranging the input and/or display field on the holding cylinder, and by mounting the holding such that it is rotatable about the rotational axis and displaceable along the rotational axis. In order to prevent the holding cylinder from undesirably rotating when the operator control ring is activated, in the neutral position, the holding cylinder can be secured against rotating about the rotational axis, and in the switched position or an intermediate position between the neutral position and the switched position, it can rotate about the rotational axis.

If the holding cylinder is of a tubular design and is mounted with the inner lateral surface of its tube passage so as to be rotatable and axially displaceable on a fixed guide cylinder, then the tilting moment of the holding cylinder can be kept small, given a small guiding diameter and a large guiding length. As a result, the holding cylinder does not stick and jam during rotation.

For attachment purposes, the guide cylinder can be fixedly arranged on a carrier component, which can at the same time be a printed circuit board. In this context, the switching element that is activated by the holding cylinder, by pressing and linearly displacing the holding cylinder along the rotational axis into the switched position, can be arranged on the carrier component.

Returning to the neutral position is easily accomplished by arranging on the carrier component a spring element, which acts on the holding cylinder in a sprung fashion in the direction of its neutral position.

As a result, the rotary transmitter and the operator control ring are also inevitably acted on in a sprung fashion.

In an embodiment, an actuator element, which projects radially into the guide cylinder through one or more openings which have a greater extent in the radial circumferential direction with respect to the rotational axis than the actuator element, is provided at an end of the holding cylinder. Here the switching element, which is arranged on the carrier component inside the guide cylinder can be activated by the actuator element. As a result a small overall size with a simple configuration is obtained.

In this context, the actuator element, can be acted on in a sprung fashion by the spring element in the direction of the neutral position of the holding cylinder, and it may be a radially extending web or a web intersection formed from a plurality of webs.

The ends of the opening or of the openings of the guide cylinder form, in the circumferential direction, stops by which the rotatability of the holding cylinder about the rotational axis is limited.

It is also easily constructed with a small number of components if that end of the opening or those ends of the openings in the guide cylinder which is/are remote from the carrier component forms/form stops which limit the axial mobility of the holding cylinder away from the switching element.

The holding cylinder can easily be locked against rotation in various rotational positions by providing the end of the opening or those ends of the openings in the guide cylinder, which is/are remote from the carrier component, with one or more axial latching depressions which are arranged at a distance from one another in the radial circumferential direction of the opening and into which the switching element or part of the switching element can latch axially.

However, for this purpose, it is also possible that at the end the opening or of the openings which is close to the carrier component a latching element is arranged which has one or more axial latching depressions that are arranged at a distance from one another in the circumferential direction of the opening, and into which the switching element or part of the switching element can latch axially in a sprung fashion.

A small overall size is obtained if the switching element is arranged centrally in the guide cylinder.

In this context it is also possible for the spring element to surround the switching element.

The spring element can easily be a helical compression spring or an elastomer component.

If the operator control ring or the rotary transmitter ring is connected to the rotary transmitter via a connection which can be overcome when a certain force is exceeded, when the holding cylinder which is fixedly connected to the rotary transmitter is rotated into another operating position, the operator control ring is simultaneously adjusted.

Here, the connection can be a frictionally locking connection.

If the connection is a latched connection, it is possible to sense satisfactorily in a haptic fashion that a set position has been reached.

In an embodiment, the input and/or display field is provided with a pushbutton key array.

Alternatively, the input and/or display field is a touch-sensitive input and/or display field on which it is possible, for example, by moving a finger on the touch-sensitive input and/or display field, to input numerals or letters by handwriting recognition.

The input and/or display field can be lit or backlit and/or can have haptic vibration feedback.

In order to avoid the penetration of dirt, it is easily possible for the end of the holding cylinder which faces away from the switching element to be closed off by the input and/or display field.

So that the input and/or display field can be reliably adjusted into its operating position, the input and/or display field or the end of the holding cylinder which faces away from the switch can have one or more driver elements which protrude axially and/or radially, a plurality of driver elements being preferably arranged distributed uniformly over the circumference of the input and/or display field or the holding cylinder.

DETAILED DESCRIPTION OF THE PRESENTLY PREFERRED EMBODIMENTS

Figure 1:
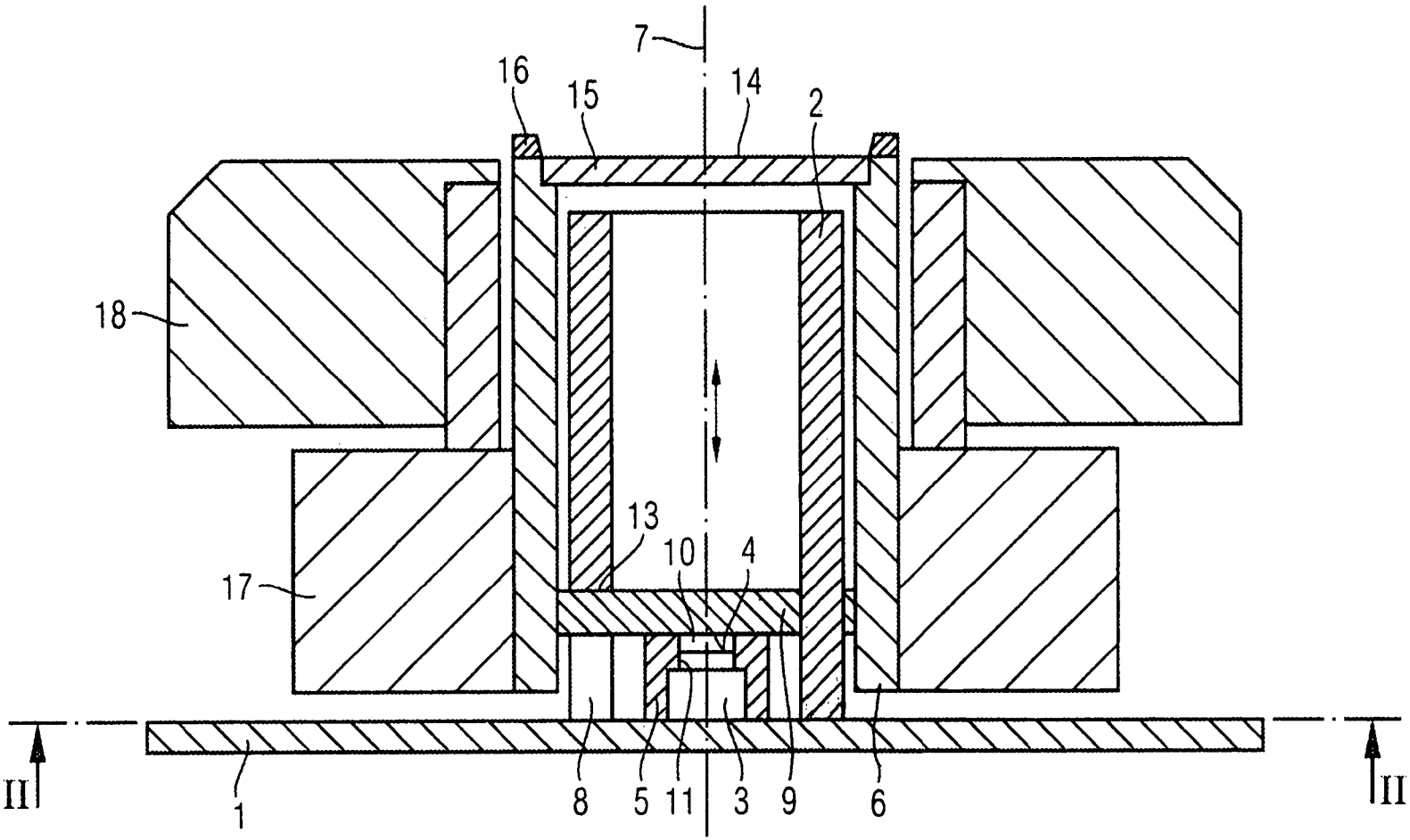
FIG. 1 shows a cross section through a rotary/pushbutton controller.

The illustrated rotary/pushbutton controller has a printed circuit board 1 which forms a carrier component and on which a tubular guide cylinder 2 is attached by its front end.

Arranged concentrically within the guide cylinder 2 is a switching element 3, which is also attached to the printed circuit board 1, and which can be activated by acting on its activation surface 4 which is located opposite the printed circuit board 1.

The switching element 3 is surrounded by an annular elastomer component 5.

On the outer cylindrical lateral surface of the guide cylinder 2, a tubular holding cylinder 6 is mounted such that its cylindrical inner wall can both be displaced axially and rotated about a rotational axis 7.

Figure 2:
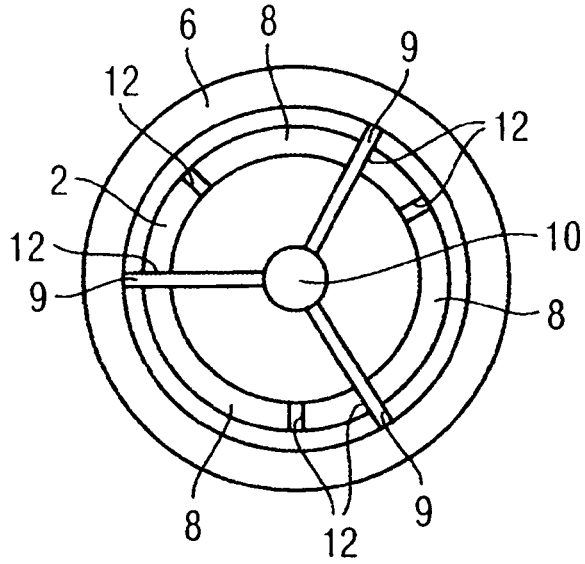
FIG. 2 is a view of a holding cylinder and guide cylinder along the line II-II in FIG. 1.

As is particularly apparent in FIG. 2, the guide cylinder 2 has, at its end facing the printed circuit board 1, three openings 8 which are distributed uniformly about its circumference and each extend over approximately 90° in the circumferential direction.

Naturally, it will be appreciated that a different length of extension other than 90° can also be selected.

Three webs 9, which are distributed uniformly over the circumference, project from the holding cylinder 6 radially with respect to the rotational axis 7, forming a web intersection, through the openings 8 into the guide cylinder 2 and are connected to one another in the center of said guide cylinder 2 by their radially inner ends by a cylindrical switching pin 10. Here, the ends of the openings 8 form stops 12 against which the webs 9 come to bear when the holding cylinder 6 rotates.

The webs 9 are fixedly arranged on the holding cylinder 6 by the radially outer ends.

The switching pin 10 projects coaxially into the cylindrical coaxial opening 11 of the elastomer component 5, and in the illustrated neutral position bears against the activation surface 4 of the switching element 3.

The webs 9 bear, with their side facing the printed circuit board 1, against that end of the elastomer component 5 which faces them, and the prestress of the elastomer component 5 causes them to bear with their side facing away from the printed circuit board 1 against the axial ends of the openings 8 which form stops 13 which are remote from the printed circuit board 1.

At the end of the holding cylinder 6 which projects beyond the corresponding end of the guide cylinder 2 and faces away from the printed circuit board 1, a disk-like closure part 15 with an input and display field 14 is fixedly inserted into the through opening in the holding cylinder 6 and closes it off.

Furthermore, a plurality of knob-like driver elements 16 which protrude axially and are distributed uniformly over the circumference are present on the front-side annular surface of the holding cylinder 6 facing away from the printed circuit board 1, which driver elements 16 can be used to rotate the holding cylinder 6 manually about the rotational axis 7.

At the end region which is relatively close to the printed circuit board 1, the holding cylinder 6 is surrounded by an annular rotary transmitter 17 which is fixedly connected to the holding cylinder 6.

At the end region of the holding cylinder 6 which is remote from the printed circuit board 1, an operator control ring 18 is mounted so as to be rotatable about the rotational axis 7. This operator control ring 18 has a coaxial rotary transmitter ring with which it comes to bear axially against the rotary transmitter 17, wherein the relative rotational position of the rotary transmitter ring, and thus also of the operator control ring 18, with respect to the rotary transmitter 17 is sensed by the rotary transmitter 17, which feeds a corresponding signal to an evaluation unit (not illustrated).

It is thus possible, for example, for a certain menu item to be chosen.

Relative positions of the rotary transmitter ring with respect to the rotary transmitter 17, which correspond to the various menu items, are defined by corresponding latched positions of a latched connection (not illustrated) between the rotary transmitter ring and the rotary transmitter 17.

Figure 3:
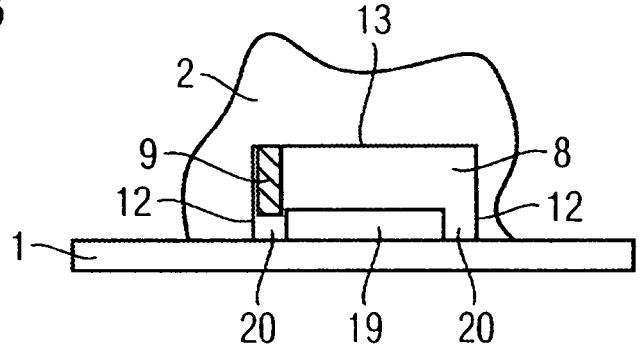
FIG. 3 shows a detail of a first exemplary embodiment of a view in the region of an opening in the guide cylinder of the rotary/pushbutton controller according to FIG. 1.

As shown in FIG. 3, in order to secure the holding cylinder 6 against rotation about the rotational axis in the illustrated neutral position in which it is moved away from the elastomer component 5 of the printed circuit board, a latching element 19 is arranged on the printed circuit board 1, which latching element 19 extends along the opening 8 and has latching depressions 20 in the circumferential direction of the opening 8 at its ends, the width of which latching depressions 20 is slightly larger than the width of the webs 9.

The webs 9 also project axially into the latching depressions 20 by a small amount. Latching positions for the holding cylinder 6 are defined by the two latching depressions 20.

If the holding cylinder 6 is to be rotated about the rotational axis 7 by its web 9 which is latched into a latching depression 20 until said holding cylinder 6 latches into the other latching depression 20, the web 9 is deformed elastically in such a way that it can be moved by the latching element 19 to then relatch into the second latching depression 20.

Figure 4:
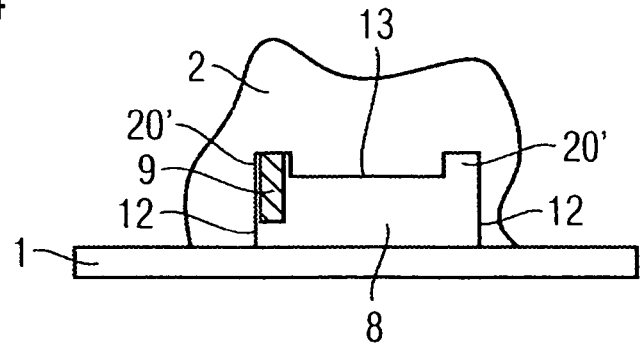
FIG. 4 is a view of a second exemplary embodiment of a view in the region of an opening in the guide cylinder of the rotary/pushbutton controller.

FIG. 4 is an additional embodiment of the function shown by way of illustration.

Here, two latching depressions 20', which are each located at the ends in the circumferential direction of the openings 8, are formed at that end of the openings 8 which forms the stops 13 and is remote from the printed circuit board 1.

These latching depressions have a somewhat larger width than the webs 9 so that in the neutral position the webs are made to engage in the latching depressions 20' by the elastomer component 5.

In order to rotate it, the holding cylinder 6 must now be moved by the depth of the latching depressions 20' in the direction of the printed circuit board 1 in order to release the latched connection.

The rotary/pushbutton controller is provided in particular for use in a motor vehicle for operating a multimedia system or navigation system or an air-conditioning system. In this context, it is possible, by rotating the operator control ring 18, to choose, for example, a menu item which is then selected by pressing the holding cylinder 6 or the operator control ring 18 or the input and display field 14 and moving the holding cylinder 6 or the operator control ring 18 out of the illustrated neutral position into the switched position which is relatively close to the printed circuit board 1 and activates the switching element 3 by means of the switching pin 10.

In an embodiment, number, letters or functional symbols which are displayed on the input and display field 14 are selected. As a result, it is possible, for example, to input a telephone number or the name of a town or a road.

In alternative embodiments, the input and display field 14 is touch-sensitive. As a result, the input and display field, can be used by moving a finger on the input and display field 14 to input numerals, letters or other characters by handwriting recognition.

In another embodiment, the switching element 3 is activated confirm the character which is to be input.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rotary/pushbutton controller, comprising:

a holding cylinder having at least one of an input field and a display field at one of its ends;

an operator control ring which is rotatably arranged about a rotational axis and rotatably mounted on said holding cylinder so that said holding cylinder is arranged coaxially within said operator control ring;

a switch element, at least one of said operator control ring and the holding cylinder being axially moveable with respect to the rotational axis counter to a spring force from a neutral position into a switched position that activates said switch element;

a rotary transmitter fixedly connected to said holding cylinder; and a rotary transmitter ring coaxially arranged on the operator control ring and arranged coaxially adjacent to said rotary transmitter such that said rotary transmitter senses a relative rotational position of said rotary transmitter ring with respect to said rotary transmitter;

wherein said at least one of the input field and the display field is rotatably mounted for rotation about the rotational axis.

2. The rotary/pushbutton controller as claimed in claim 1, wherein said at least one of the input field and display field is fixedly arranged on said holding cylinder, and said holding cylinder is rotatably mounted for rotation about the rotational axis.

3. The rotary/pushbutton controller as claimed in claim 2, wherein in the neutral position, said holding cylinder is secured against rotating about the rotational axis, and in one of the switched position and an intermediate position between the neutral position and the switched position, said holding cylinder is rotatable about the rotational axis.

4. The rotary/pushbutton controller as claimed in claim 2, further comprising a fixed guide cylinder, wherein said holding cylinder is tubular having an inner lateral surface and said holding cylinder being mounted by said inner lateral surface so as to be rotatable and axially displaceable on said fixed guide cylinder.

5. The rotary/pushbutton controller as claimed in claim 3, further comprising a fixed guide cylinder, wherein said holding cylinder is tubular having an inner lateral surface and said holding cylinder being mounted by said inner lateral surface so as to be rotatable and axially displaceable on said fixed guide cylinder.

6. The rotary/pushbutton controller as claimed in claim 4, further comprising a carrier component, wherein said fixed guide cylinder is fixedly arranged on said carrier component.

7. The rotary/pushbutton controller as claimed in claim 6, wherein said carrier component is a printed circuit board.

8. The rotary/pushbutton controller as claimed in claim 2, further comprising a carrier component, wherein the switching element is arranged on said carrier component.

9. The rotary/pushbutton controller as claimed in claim 2, further comprising a carrier element and a spring element arranged on said carrier component, said spring element exerting a spring force on said holding cylinder in the direction of the neutral position of the holding cylinder.

10. The rotary/pushbutton controller as claimed in claim 6, wherein said holding cylinder has an actuator element projecting radially into said guide cylinder through at least one opening in said guide cylinder, said actuator element arranged at an end region of said holding cylinder facing said carrier component, said opening having a greater extent in a circumferential direction with respect to the rotational axis than said actuator element, and said switching element arranged on said carrier component inside said guide cylinder is activatable by said actuator element.

11. The rotary/pushbutton controller as claimed in claim 10, further comprising a spring element arranged on said carrier component, said spring element exerting a spring force on said actuator element in the direction of the neutral position of said holding cylinder.

12. The rotary/pushbutton controller as claimed in claim 10, wherein said actuator element is a radially extending web or a web intersection formed from a plurality of webs.

13. The rotary/pushbutton controller as claimed in claim 10, wherein circumferential ends of the at least one opening of the guide cylinder define stops which limit the rotatability of the holding cylinder about the rotational axis.

14. The rotary/pushbutton controller as claimed in claim 10, wherein an axial end of the at least one opening in the guide cylinder, which is remote from the carrier component, defines a stop which limits axial mobility of said holding cylinder away from said switching element.

15. The rotary/pushbutton controller as claimed in claim 14, wherein the at least one opening in the guide cylinder defines at least one axial latching depression into which at least a part of actuator element is axially latchable.

16. The rotary/pushbutton controller as claimed in claim 15, wherein said at least one axial latching depression is defined at an axial end of the at least one opening which is close to said carrier component.

17. The rotary/pushbutton controller as claimed in claim 15, wherein said at least one axial latching depression is defined at an axial end of the at least one opening which faces away from said carrier component.

18. The rotary/pushbutton controller as claimed in claim 15, wherein said at least one axial latching depression comprises a plurality of axial latching depressions circumferentially spaced from one another.

19. The rotary/pushbutton controller as claimed in claim 5, wherein the switch is arranged centrally in the guide cylinder.

20. The rotary/pushbutton controller as claimed in claim 19, further comprising a carrier element and a spring element arranged on said carrier component, said spring element exerting a spring force on said holding cylinder in the direction of the neutral position of the holding cylinder, wherein said spring element surrounds the switching element.

21. The rotary/pushbutton controller as claimed in claim 9, wherein said spring element is one of a helical compression spring and an elastomer component.

22. The rotary/pushbutton controller as claimed in claim 2, wherein one of the operator control ring and the rotary transmitter ring is connected to the rotary transmitter by a releasable connection which is released upon exceeding a predetermined force.

23. The rotary/pushbutton controller as claimed in claim 22, wherein the releasable connection is a frictionally locking connection.

24. The rotary/pushbutton controller as claimed in claim 22, wherein the releasable connection is a latched connection.

25. The rotary/pushbutton controller as claimed in claim 1, wherein said at least one of the input field and the display field is a pushbutton key array.

26. The rotary/pushbutton controller as claimed in claim 1, wherein said at least one of the input field and the display field is a touch-sensitive input.

27. The rotary/pushbutton controller as claimed in claim 1, wherein said at least one of the input field and display field is one of lighted and backlighted.

28. The rotary/pushbutton controller as claimed in claim 1, wherein said at least one of the input and the display field has haptic vibration feedback.

29. The rotary/pushbutton controller as claimed in claim 1, wherein said at least one of the input field and the display field is mounted on and closes an end of the holding cylinder which faces away from said switching element.

30. The rotary/pushbutton controller as claimed in claim 1, wherein said at least one of the input field and the display field or an end of the holding cylinder which faces away from the switching element includes at least one driver element protruding axially and radially.

31. The rotary/pushbutton controller as claimed in claim 30, wherein said at least one driver element comprises a plurality of driver elements distributed uniformly over a circumference of said at least one of the input field and the display field or an end of the holding cylinder which faces away from the switching element.

* * * * *